US005231594A

United States Patent [19]

Knibiehler et al.

[11] Patent Number: 5,231,594

[45] Date of Patent: Jul. 27, 1993

[54] MAINTENANCE MONITORING SYSTEM

[76] Inventors: Ernst Knibiehler, St. Johannsplatz 18, Basel CH-4056; Henrik Nielander, Kapfstrasse 8, Zurich CH-8032, both of Switzerland

[21] Appl. No.: 613,791

[22] PCT Filed: Mar. 29, 1990

[86] PCT No.: PCT/CH90/00082

§ 371 Date: Jan. 10, 1991

§ 102(e) Date: Jan. 10, 1991

[87] PCT Pub. No.: WO90/12375

PCT Pub. Date: Oct. 18, 1990

[30] Foreign Application Priority Data

Apr. 11, 1989 [CH] Switzerland ..... 1362/89

[51] Int. Cl.[5] ..... G07C 3/00

[52] U.S. Cl. ..... 364/551.01; 377/15; 377/16

[58] Field of Search ..... 364/550, 551.01, 551.02; 377/15, 16

[56] References Cited

U.S. PATENT DOCUMENTS

| | | | |
|---|---|---|---|
| 2,946,646 | 7/1960 | Bower et al. | 346/33 |
| 3,275,987 | 9/1966 | Mann | 340/147 |
| 3,290,669 | 12/1966 | Mews | 340/267 |
| 3,546,693 | 12/1970 | Bissett et al. | 340/309.1 |
| 3,558,924 | 1/1971 | Lindell | 307/260 |
| 3,559,188 | 1/1971 | Proctor | 340/172.5 |
| 3,603,880 | 9/1971 | Brecker, Jr. et al. | 324/182 |
| 3,864,560 | 2/1975 | Dening | 235/151.13 |
| 3,921,152 | 11/1975 | Hagar et al. | 364/550 X |
| 3,938,128 | 2/1976 | Pidsosny et al. | 340/309.1 |
| 4,135,246 | 1/1979 | McMannis | 364/551 |
| 4,159,531 | 6/1979 | McGrath | 364/900 |
| 4,208,718 | 6/1980 | Chung | 364/474 |
| 4,237,371 | 12/1980 | LeBouder | 235/92 PD |
| 4,245,316 | 1/1981 | Kolkawa et al. | 364/474 |
| 4,260,986 | 4/1981 | Kobayashi et al. | 340/680 |
| 4,276,468 | 6/1981 | Nagamoto et al. | 235/92 CT |
| 4,346,446 | 8/1982 | Erbstein et al. | 364/551.01 |
| 4,389,709 | 6/1983 | Knibiehler et al. | 364/551 |
| 4,404,641 | 9/1983 | Bazarnik | 377/16 X |
| 4,432,064 | 2/1984 | Barker et al. | 364/550 |
| 4,517,637 | 5/1985 | Cassell | 364/551.01 X |
| 4,612,623 | 9/1986 | Bazarnik | 364/569 |
| 4,688,183 | 8/1987 | Keine | 364/554 |
| 4,933,885 | 6/1990 | Kato et al. | 364/551.01 |
| 5,008,842 | 4/1991 | Nagai et al. | 364/551.02 X |

FOREIGN PATENT DOCUMENTS

| | | |
|---|---|---|
| 0026869 | 9/1981 | European Pat. Off. . |
| 2263452 | 12/1972 | Fed. Rep. of Germany . |
| 2823558 | 1/1979 | Fed. Rep. of Germany . |
| 2142172 | 6/1985 | United Kingdom . |

OTHER PUBLICATIONS

"Multiphase One Shot Provides Pulses", Electronic Engineering, dated Sep. 1976 p. 21.

"Electronic Sequencer With Programmable Time Delays", pp. 5323 and 5324 IBM Technical Disclosure Bulletin, vol. 20, No. 12, May 1978.

"Op Amps Give Mutually-Exclusive Digital Sequencing", p. 80 The Electronic Engineer, Aug. 1969.

*Primary Examiner*—Edward R. Cosimano

*Attorney, Agent, or Firm*—Louis Weinstein

[57] ABSTRACT

In order to oversee and plan, at overall shop level, the execution of maintenance work on several installations (1), each having monitoring equipment (3) which monitors the intervals at which maintenance should be carried out on the installations, it is proposed that the outputs ($A_3$) from the monitoring equipment (3) be fed to a processing unit (27) which produces maintenance status reports (53) for the whole shop. Registers, which store certain maintenance intervals, are reset only upon recognition of maintenance personnel at the site of the installation by manual input and recognition of the condition at the processing unit by a remote input.

17 Claims, 3 Drawing Sheets

MAINTENANCE MONITORING SYSTEM

FIELD OF THE INVENTION

The present Invention relates to a maintenance monitoring system for a plurality of installations in which maintenance work must be performed individually after respective expirations of maintenance time intervals.

BACKGROUND OF THE INVENTION

Maintenance monitoring devices which are arranged on installations such as machine tools are known such as, for instance, from the European publication EP-B-O 026 869. The time intervals of the operation of such machines which are relevant regarding the maintenance are registered by such maintenance monitoring devices. After expiration of pre-set maintenance time intervals within the mentioned maintenance relevant interval of the operation, a respective signal which is specific regarding the maintenance interval is emitted, for instance, for a lubrication of a first kind after 100 hours of operation, for lubrications of a second kind after 150 hours of operation, etc. After the maintenance work has been completed the corresponding displays are re-set and the mentioned maintenance time intervals are also re-set such that, after the maintenance within the frame of the maintenance relevant interval of operation they start to run cyclically anew.

These monitoring systems for the maintenance of installations have proven to be good.

However, in production plants having a plurality of machines to be monitored, one of these mentioned maintenance monitoring devices must be arranged at each such machine and there is the demand to obtain, such as for the planning of the maintenance, for the calling of maintenance teams, the appropriate of corresponding auxiliary material for the maintenance such as lubricants, etc. an overview over the complete state and demands, respectively of the maintenance of all installations and machines respectively.

From the British specification GB-A-2 142 172 it is known to selectively monitor electronic modules of an electronic plant and to store and emit maintenance information regarding the modules. Because all modules of the plant are simultaneously put into operation and switched off, respectively to which end energy is centrally switched to the plant and switched off, respectively the here represented procedure cannot satisfy above demands: this known maintenance technique corresponds to a maintenance monitoring device of a kind basically known from the European specification EP-B-0 026 869 applied to an electronic plant having various plant modules.

From the US-specification U.S. Pat. No. 4,688,183 a plant is known by means of which the most different data can be recorded and monitored, respectively at a building which allow to proceed with repair work at the correct time. A plurality of sensors structured to correspond to the data to be recorded are foreseen at the building which, organized hierarchically, are finally fed to a central unit. Because it is not foreseen to monitor at one and the same operation plant of the building such as at an elevator a plurality of different mutually overlapping maintenance intervals the entire building is here basically to be considered as an in-an-entirety operated plant corresponding to the monitored plant according to the EP-B-0 026 869 and the technique disclosed here can also not satisfy the above mentioned demands.

From the German specification DE-OS 28 23 558 a maintenance monitoring computer for machine plant is known which is employed similar to the monitoring device according to the EP-B-0 026 869, and thus operates at the level of operating plants and is not in a position to satisfy the above demand for a plurality of such plants.

SUMMARY OF THE INVENTION

It is an object of the present invention to provide a maintenance monitoring system of the kind mentioned above which provides the above mentioned overview in a most simple fashion.

This is achieved in accordance with the present invention in that one monitoring maintenance device is arranged at every installation which at the one hand registers maintenance relevant operation time intervals of the installation and at the other hand after expiration of maintenance time intervals specific to installations emits a signal at an output which identifies the installation, the expired maintenance time interval, in that the outputs of all foreseen maintenance monitoring devices are led to a central evaluation unit at which the output signals of the maintenance monitoring device are evaluated and overview of the state of the maintenance is displayed.

If now such a central evaluating unit is foreseen for the inventive evaluating of the data of the state of the maintenance it is proposed further to switch further monitoring devices such as for fire, gas leaks, water leaks, leak of radioactivity and the maintaining of specified temperatures and/or temperature ranges onto the same central evaluation unit and to employ it then generally for the monitoring.

Furthermore, it is thereby proposed to switch such a central evaluating unit depending upon the respective demand into a network with further data processing units, for instance to coordinate the monitoring at differing levels, thereby specifically also the maintenance, such as, for instance, at division, plant, group levels.

In order to facilitate the interpretation of the data and in order to allow immediately a notice specifically regarding the state of the maintenance of the production installations switched into the system it is, furthermore, proposed to make the display at the central evaluation unit via a screen.

Depending upon the local conditions and the distance which prevail at the one hand between maintenance monitoring devices and central evaluation unit, and central evaluation unit and further places, respectively which have an interest in its information at the other hand, it is further proposed to transmit at least one part of the connections towards the outside via long-distance transmission connections such as via wireless connections or wirebound, via the telephone networks, via the television network or via separate safety networks.

BRIEF DESCRIPTION OF THE FIGURES

Hereinafter, the invention will be explained in exemplary fashion based on the figures.

These examples are shown in.

DETAILED DESCRIPTION OF THE INVENTION AND ITS PREFERRED EMBODIMENTS

Figure 1:
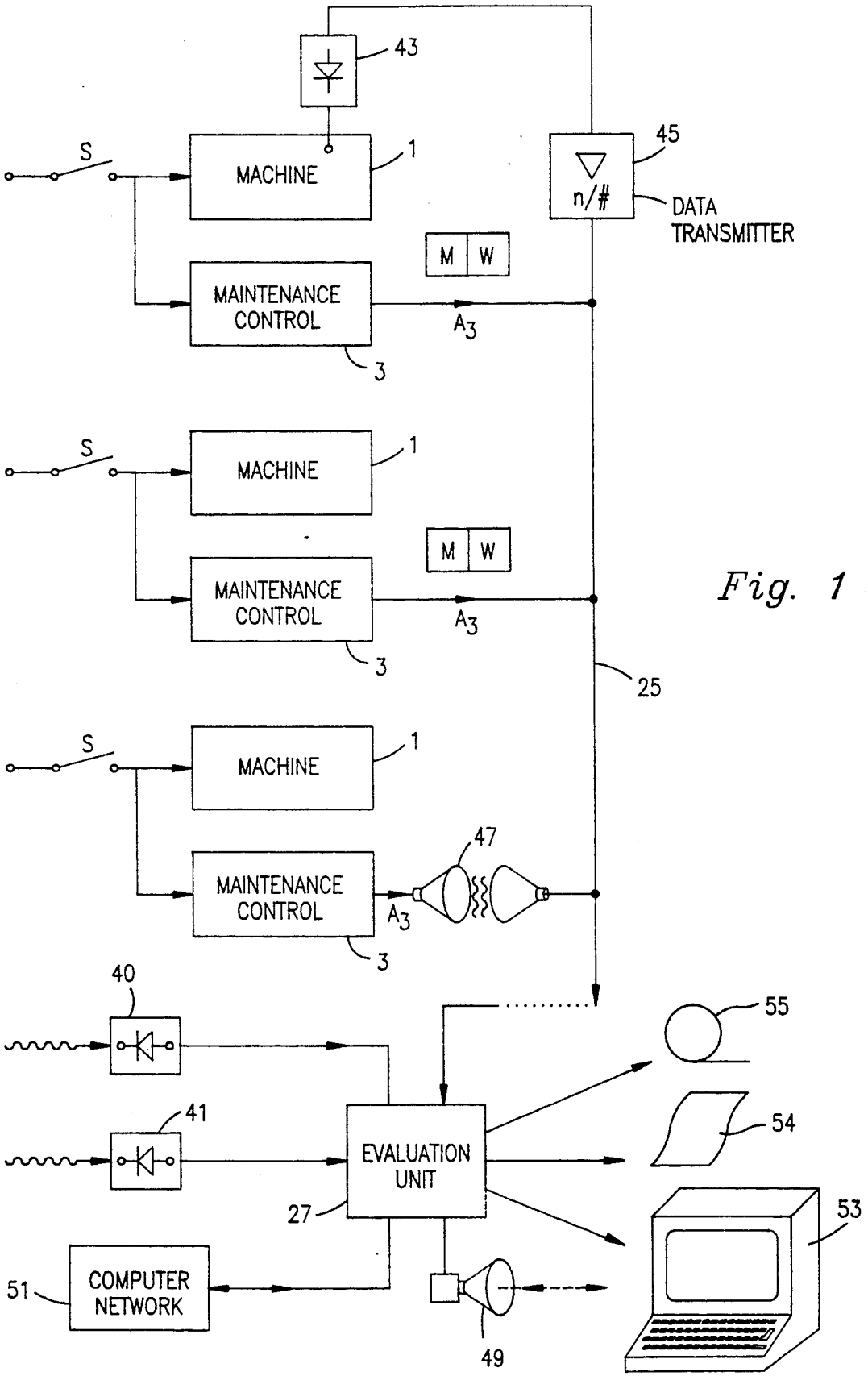
FIG. 1, which is a block diagram of a inventive maintenance monitoring system, for instance, for three machines, as installations, FIG. 2, which is a block diagram of a maintenance monitoring system such as applied at the inventive maintenance monitoring system according to FIG. 1, FIG. 3, which is a block diagram of a central evaluation unit such as, for instance, applied at the inventive maintenance monitoring systems according to FIG. 1.

In FIG. 1 a plurality of machines 1, for instance three, of a production plant are illustrated graphically. The machines are individually put into operation by an associated operation switch S in that they are switched into the electric network. A maintenance monitoring device 3 is allocated to every machine 1, usually mounted to the machine 1 or in the immediate vicinity thereof. As soon as the machine 1 is set into operation by the operation of switch S the respective allocated maintenance monitoring device 3 is also activated. Such maintenance monitoring devices 3 are known, for instance from EP-B-0 026 809.

Figure 2:
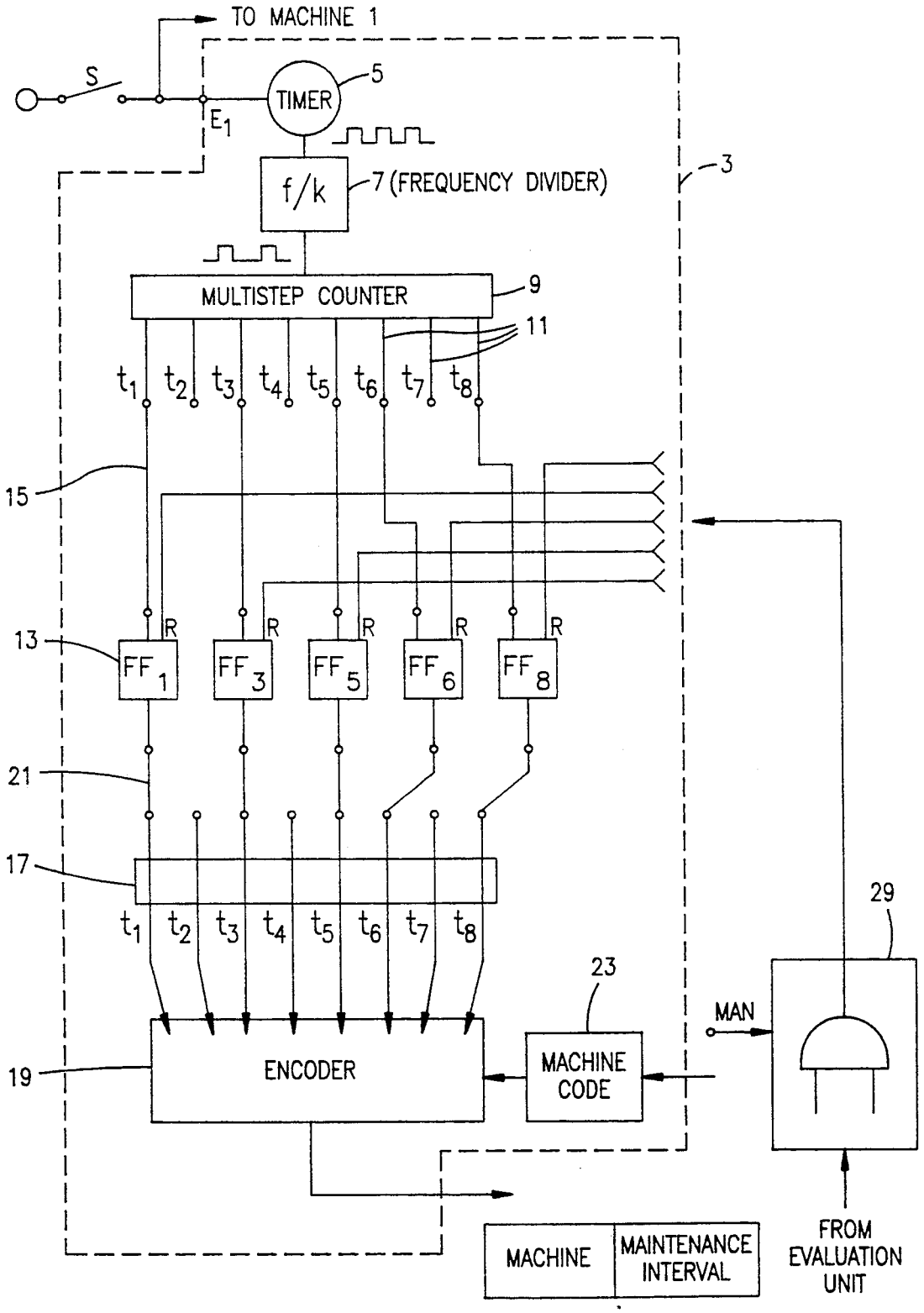

A set-up selected as an example for the object of the duty here under consideration is illustrated in FIG. 2. Accordingly, a maintenance monitoring device 3 includes a input $E_1$ onto which according to FIG. 1 a signal is applied via the operation switch S which corresponds to the maintenance relevent operation conditions of the machine 1 according to FIG. 1. It is for instance a signal derived from the electrical supply to the machine 1. This signal applied at the input $E_1$ is applied at a timer 5 which, activated by this signal emits at its output an impulse train of a pre-set frequency f. This output impulse train is conveyed via a frequency divider 7 and at the output of the frequency divider 7 an impulse train having the repeating frequency f/k appears, accordingly when the corresponding machine is set into operation.

The output signal of the frequency divider 7 is applied at a multistep counter 9 which includes a plurality of step count outputs 11, corresponding in a known kind for instance to the count $2^0$, $2^1$, $2^2$ . . . . The counter 9 is basically designed such that in present time intervals a preset signal sequence appears at one of its step count outputs 11, may such be a rising or falling signal flank. The signals appearing at these outputs are accordingly relevant for preset time spans $\tau_x$ during which the signal generator or timer 5, respectively was activated.

Furthermore, a plurality of re-settable storing elements 13 are at the outlet side of the counter 9, for instance in the form of the illustrated flip-flops. The number of the forseen flip-flop circuits corresponds in case of a standard design of such a maintenance monitoring device to a standard number of maintenance intervals to be monitored. If more of such maintenance intervals are to be monitored at a machine 1, two or more of the illustrated maintenance monitoring devices 3 are switched in parallel.

Now, various kinds of the machines 1 illustrated generally in FIG. 1 call for a monitoring of differing maintenance intervals. Therefore, the storage elements 13 are not fixedly connected to the count step outputs 11 of the counter 9 but can, such as for instance, by connecting bridges 15, be connected selectively to those count step outputs 11 which correspond to the desired maintenance intervals $\tau_x$ to be monitored at a specific machine.

Quite obviously, the storage elements 13 each can instead of the selectively applied connecting bridges be electronically switched for instance via a switching over unit such as a multiplexer unit selectively onto the count step outputs 11 corresponding to the desired maintenance intervals.

All storage elements 13 each include, furthermore, a re-set input R which, such as will be further described, can either be activated by a manual operation at the monitoring device 3 or can be remote-controlled electronically. Decisive is that it is possible to re-set individually each storage element 13 after it has been activated by the output signal of the corresponding count step. The resetting indicates that a maintenance performance which has been characterized as due by activating of the corresponding storage element 13 has been performed at the machine 1.

Corresponding to the number of possibly used count step outputs 11 a number of output connections 17 are led to a encoder 19. In order to allow a as simple as possible encoding outputs of the storage elements 13 are switched to those outputs 17, again via connecting bridges or switches 21, which correspond to those count step outputs 11 which the input-side flip-flops 13 are allocated to. Accordingly, a clear allocation is arrived at in that then when for instance a signal appears at the output which corresponds to the maintenance time spand $\tau_1$ it is certain that this signal does indeed correspond to the maintenance interval $\tau_1$. The outputs 17 are connected to the encoder 19 such as mentioned which every time when one or a plurality of the storage elements 13 is activated indicates that the corresponding maintenance time interval monitored by the respective storage element 13 has expired and emits an output signal which contains coded data such as schematically illustrated at the one hand an identification of the machine 1 which can be inputted at the unit 3 and stored there in a memory 23 which is allocated to the monitoring device 3, and at the other hand data which indicate that and which maintenance time interval $\tau_x$ has been registered as elapsed.

Reviewing again FIG. 1, signals are accordingly emitted at the output of the maintenance monitoring devices 3 always when one or a plurality of maintenance intervals $\tau_x$ monitored by the device 3 at the respective allocated machine 1 has or have expired.

The outputs $A_3$ of all monitoring devices 3 are fed now via a data and possibly control connection line 25 which obviously, such as is the general practice for the transmission of digital data and/or control signals as multi-conduit line, to a central evaluation unit 27. This can be a common computer installation. Generally, all information received, specifically regarding the machines 1 which are connected to the line 25, such as expired maintenance time intervals, the maintenance performed, possibly additional information such as the expenditure or time needed for maintenance which was indicated, material needs, etc. is displayed. The display is made such as schematically illustrated in FIG. 1 for instance by a printing on paper 54 (by a suitable printer, not shown), specifically by a display on a screen 53, thereby possibly with a keeping of a record on a storage disc or tape 55 (by a suitable recording device, not shown).

Due to the fact that the output data of the maintenance monitoring devices 3 connected into the entire plant are evaluated whereby such an evaluation is realizable without may further ado as desired by the person skilled in the art, it is now possible to perform maintenance schedules for production plants at an optimizing of maintenance teams to be enlisted, maintenance aids to be made available such as lubricants, etc. and additionally it is possible to make a total record of what has been performed at the machine and when it has been performed.

Seen from the point of view of the safety of operation it is thereby of a decisive importance that a re-setting of the storage elements 13 of the maintenance monitoring devices 3 and illustrated in FIG. 2, which display the expiration of respective maintenance time intervals is made only then when the corresponding maintenance has truly been made.

Such as already mentioned it is absolutely possible to perform such as described in the EP-B-0 026 869 by a manual re-set operation at the respective maintenance monitoring device 3 such a "maintenance made"—indicating re-setting. At the other hand such a re-setting can obviously be accomplished by an input for instance by operating a key at the evaluation unit 27. Preferably, however, it is preferred to provide an AND-logic 29 at the maintenance monitoring device 3 such as schematically illustrated in FIG. 2, and which comprises at the input side manually operable re-setting switches MAN and inputs for the re-setting signals from the evaluating unit 27 and which act at the output side onto the corresponding re-setting signals R at the storage elements 13.

By means of this it is achieved that the actual resetting of the corresponding storage elements 13 at the monitoring unit 3 proceeds only then when at the one hand the respective maintenance work has been acknowledged as performed by a manual input and, additionally, this performance has been acknowledged as checked from the central evaluation unit 27.

Figure 3:
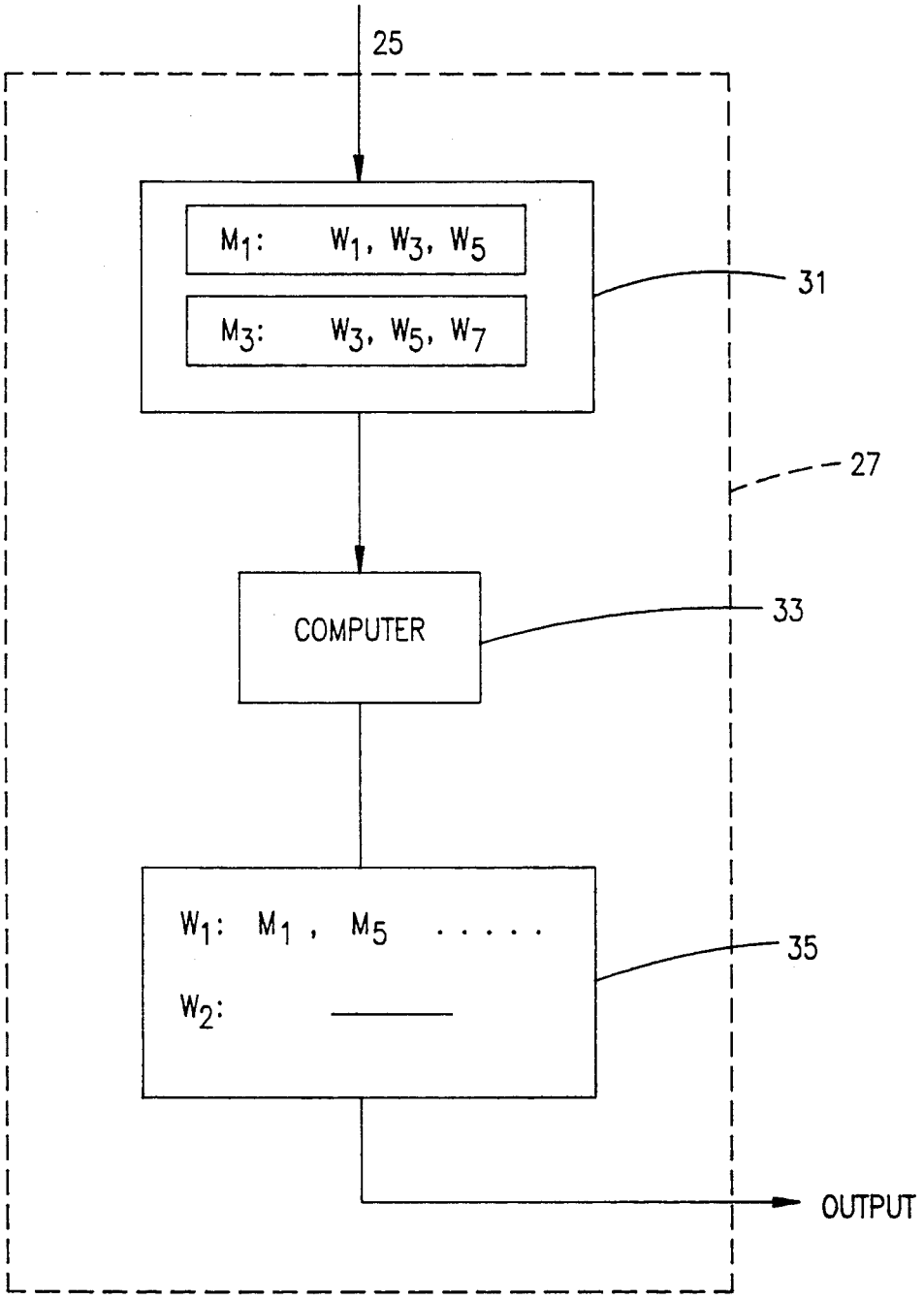

The principle structuring of the evaluation unit 27 is illustrated schematically in FIG. 3. The data fed via the data and possibly control line (such as for the re-setting control signals) 25 are led to a input store 31 for instance in form of stored data sentences including the respective machine M and the maintenance work W due at this machine, the latter being according the corresponding maintenance intervals $\tau_X$.

The data sentences stored in the input store 31 are processed if desired at a computer unit 33 and outputted for instance at an output store 35 in form of data sentences, including the indication of the maintenance work W and a listing of those machines M on which this specific maintenance work must now be performed.

The data sentences stored in the data store 35 are emitted. Quite obviously it is possible to also compute with such an evaluating unit 27 which preferably comprises computer listings of the time spans remaining up to the expiration of pre-set maintenance time intervals, to keep statistics, etc. It is possible to perform by means of the invention described in plants having a plurality of installations such as a plurality of machines an optimization and clean record of maintenance times and maintenance work.

Such as can be clearly seen in FIG. 1, further monitoring devices can be switched to the evaluation unit 27 such as for instance smoke or fire annunciators 40, radio activity annunciators 41 in case of a monitoring of nuclear power plants, temperature monitoring apparatuses 43, the latter for instance being arranged directly at the machines 1 being monitored, whereby, their output signals after amplification and analog-digital conversion are switched onto a unit 45, for instance also the line 25. By means of this technique the capability of the foreseen evaluation unit 27 is fully made use of and it is generally employed as a monitoring unit. The transmission inside of the inventive plant, i.e. up to the evaluation unit 27 can proceed thereby via long distance transmitting links such as wireless radio beam transmissions, telephone networks, TV-networks, etc. such as schematically illustrated at 47. By the same token a transmission at the output side of the evaluation unit 27 can be made to arbitrary registration locations such as indicated at 49 via long distance transmitting links, wireless, wire-bound, via the telephone network, or via the TV-network, such as also for instance a transmission to computers which are switched parallel or are superordinated which form together with the evaluation unit 27 utilized in accordance with the invention a network such as illustrated at 51.

For an immediate clear interpretation of the data supplied the evaluating unit 27 is specifically equipped with a display screen 53 with an input keybord whereby the mentioned schedules and overview tables are displayed.

We claim:

1. A maintenance monitoring system for a plurality of independent unrelated distinguished installations where each installation may comprise one or more devices requiring maintenance at which individually after expiration of maintenance time intervals different types of maintenance work must be performed, comprising:

a monitoring maintenance device arranged at every installation, each maintenance device including means responsive to operation of an associated installation to measure the elapsed time the installation is operating, means responsive to said means to measure for registering predetermined maintenance relevant operation time intervals of the associated installation and means responsive to expiration of maintenance time intervals for emitting a respective signal specific to each predetermined maintenance time interval to an associated output, and the outputs of the maintenance monitoring devices being led through a common link to a central evaluation unit for evaluating the output signals of the maintenance monitoring devices, said unit including means for displaying an overview of the state of the maintenance of all installations.

2. A system according to claim 1, further comprising at least one monitoring device for monitoring at least one of the conditions including fire, gas, radioactivity, and temperature of the installation being monitored is coupled to the central evaluation unit.

3. A system according to claim 1 or claim 2, wherein the central evaluation unit is connected by way of a network system to further data processing plants.

4. A system according to claim 1 or claim 2, wherein a display occurs at least at the central evaluation unit which is provided with a screen unit.

5. A system according to claim 1 or claim 2, wherein at least a part of the transmission connections inside of the plant and outwards transmission connections comprise long distance transmission connection means such as wire-bound via the telephone network, or wireless via the television network.

6. A system according to claim 1 wherein the outputs of said monitoring maintenance devices are all connected in common to said evaluation unit;

each monitoring maintenance device comprising memory means for for storing data identifying the installation requiring maintenance and means for transmitting the respective signals and the data in said memory means to said evaluation unit.

7. A system according to claim 1 further comprising logic means responsive to a manual input entered to indicate that maintenance on the machine has been performed and to an acknowledgement input generated by the evaluation unit for resetting said means for registering.

8. A system according to claim 1 wherein at least selected ones of said maintenance devices provide measurements of a plurality of elapsed times, the outputs of said selected ones of said maintenance monitoring devices being transmitted to said central evaluation unit each time an elapsed time condition occurs.

9. A system according to claim 1 wherein said evaluation unit further comprises:

storage means for storing data corresponding to the maintenance operation to be performed for each maintenance interval; and means responsive to the maintenance interval signal received from a monitoring maintenance device means for outputting the data stored in said storage means to the central evaluation unit.

10. A system according to claim 9 wherein display means are provided for displaying the maintenance data received by said central evaluation unit.

11. A system according to claim 1 wherein each monitoring maintenance device means for measuring further comprises means responsive to activation of the associated installation for generating timing pulses;

means for counting said timing pulses; and means responsive to predetermined counts of said timing pulses for transmitting a signal specific to a maintenance time interval to said evaluation unit.

12. A system according to claim 11 further comprising means for transmitting a code identifying the installation transmitting a signal specific to the maintenance time interval and stored in a memory means each time a signal specific to the maintenance time interval is generated.

13. A system according to claim 12 wherein said means for registering stores a condition indicating that an associated predetermined count has been reached by said counting means.

14. A system according to claim 13 further comprising means responsive to a manual input operated when a maintenance operation associated with a predetermined storage means is performed and when a check signal at the evaluation unit is generated for resetting the means for registering to clear the condition stored therein.

15. A maintenance monitoring system for a plurality of unrelated installations of various different types, individually put into operation independently of one another, comprising:

each installation (1) having a monitoring maintenance device (3), each monitoring maintenance device including:

means (29) for acknowledging maintenance operations performed at the associated installation, means (9) responsive to operation of an installation for measuring the time span the associated installation has been in operation, means (13) responsive to said means (9) for measuring and to said means for acknowledging (29) and monitoring predetermined maintenance time intervals departing from respective acknowledgements of maintenance operations performed by said means for acknowledging and for emitting signals indicative of said monitored maintenance time intervals, said maintenance monitoring system further comprising:

a central evaluation unit (27);

means at each installation for coupling said signals of each of said means for monitoring maintenance time intervals to said central evaluation unit; and said central evaluation unit including means (53) for displaying an overview of the state of said monitored maintenance time intervals of all said installations (1).

16. A system according to claim 15 wherein said central evaluation unit includes means for generating an acknowledge signal for acknowledging the monitored maintenance time interval associated with a predetermined installation; and said means for acknowledging maintenance operations including means responsive to at least the acknowledge signal of said central evaluation unit to clear a signal indicative of the monitored maintenance time interval.

17. A system according to claim 16 wherein said means for acknowledging maintenance operations further includes means for clearing said signal indicative of a monitored maintenance time interval upon receipt of both an acknowledgement signal from said central evaluation unit and a local acknowledgement signal produced upon completion of the maintenance operation associated with the monitored maintenance time interval.

* * * * *

UNITED STATES PATENT AND TRADEMARK OFFICE

CERTIFICATE OF CORRECTION

PATENT NO. : 5,231,594

DATED : July 27, 1993

INVENTOR(S) : Ernst Knibiehler
Henrik Nielander

It is certified that error appears in the above-indentified patent and that said Letters Patent is hereby corrected as shown below:

Column 3, line 28, change "relevent" to --relevant--

Column 3, line 52, delete "the forseen"

Column 4, line 18, delete "allow a" and insert --provide an arrangement which is--

Column 4, line 19, after "possible" insert --,--

Column 4, line 26, change "spand" to --span--

Column 4, line 66, change "may" to --any--

Column 5, line 27, after "this" insert --technique--

Signed and Sealed this

Twenty-sixth Day of April, 1994

*Attest:*

Bruce Lehman

BRUCE LEHMAN

*Attesting Officer*

*Commissioner of Patents and Trademarks*